US005362056A

United States Patent [19]

Minotti

[11] Patent Number: 5,362,056

[45] Date of Patent: Nov. 8, 1994

[54] HEADS FOR GOLF CLUBS

[76] Inventor: Peter Minotti, 2755 Old River Rd., Easton, Pa. 18042

[21] Appl. No.: 897,301

[22] Filed: Jun. 11, 1992

[51] Int. Cl.[5] ..... A63B 53/04

[52] U.S. Cl. ..... 273/175; 273/167 C

[58] Field of Search ..... 273/167–175, 273/80.2, 79, 67 C, 77 R, 192, 193 R, 194 R, 194 A, 194 B, 193 A, 193 B, 162 R; D21/210, 211, 214–219

[56] References Cited

U.S. PATENT DOCUMENTS

| | | | |
|---|---|---|---|
| 1,177,266 | 3/1916 | Pedersen | 273/167 C |
| 1,983,196 | 12/1934 | Spiker | 273/79 |
| 2,388,463 | 11/1945 | Benecke | 273/175 |
| 3,319,964 | 5/1967 | Steinberg | 273/192 X |
| 3,394,937 | 7/1968 | Allport | 273/167 C |
| 3,578,325 | 5/1971 | Teas | 273/168 X |
| 3,840,231 | 10/1974 | Moore | 273/79 |
| 3,908,996 | 9/1975 | Molinaro | 273/175 X |
| 3,909,005 | 9/1975 | Piszel | 273/171 |
| 3,989,257 | 11/1976 | Barr | 273/167 J X |
| 4,508,342 | 4/1985 | Drake | 273/167 C X |
| 4,688,799 | 8/1987 | Johnson | 273/174 |
| 4,776,594 | 10/1988 | Rango | 273/167 A X |
| 4,861,038 | 8/1989 | Fucinato | 273/167 C X |
| 4,872,684 | 10/1989 | Dippel | 273/167 C X |
| 4,881,737 | 11/1989 | Mullins | 273/167 C X |
| 5,083,779 | 1/1992 | Ungermann | 273/168 X |
| 5,090,698 | 2/1992 | Kleinfelter | 273/167 C X |
| 5,172,915 | 12/1992 | Flis | 273/174 X |
| 5,174,567 | 12/1992 | Nordstrom | 273/67 A |

FOREIGN PATENT DOCUMENTS

| | | | |
|---|---|---|---|
| 1470768 | 4/1977 | United Kingdom | 273/171 |

*Primary Examiner*—Sebastiano Passaniti
*Attorney, Agent, or Firm*—John Lezdey

[57] ABSTRACT

The invention provides a putter clubhead having a substantially cylindrical striking head to avoid causing the ball to skid or jump on long putts. There is further provided a putter having a substantially cylindrical and rotatable striking portion.

5 Claims, 1 Drawing Sheet

HEADS FOR GOLF CLUBS

FIELD OF THE INVENTION

The present invention relates to golf clubs and more particularly to heads for putters having an advantageous construction.

BACKGROUND OF THE INVENTION

The design of a putter according to the rules of the United States Golf Association require that the shaft or neck or socket of a putter be fixed at any point in the head and need not remain in line with the heel. The axis of the shaft from the top to a point not more than five (5) inches (127 mm) above the sole shall diverge in the toe-heel plane from the vertical by at least ten (10) degrees in relation to the horizontal line determining the length of the head.

The clubhead of the putter provides that the length of the clubhead shall be greater than the breath. These measurements are made on horizontal lines between the vertical projections of the extremities when the clubhead is grounded in its normal address position. The rules further permit that only for putters can furrows or runners extend into the face.

Conventional putters have a flat face which when striking the ball, especially on a long putt, causes the ball to skid. The skidding causes a loss of control of the ball since the ball can jump off the ground especially on a long putt. Skidding can amount to 20% of the distance to the hole in long putts.

SUMMARY OF THE INVENTION

The present invention relates to overcoming the difficulties found in putters by providing a golf club head for a golf club which is to be used as a putter, The present invention provides a golf club head which is cylindrical.

The novel construction permits use of the putter in either left handed or right handed swings or in other ways best adapted to address the ball in play which may occupy awkward positions or difficult "lies".

In accordance with another embodiment of the invention there is provided a putter with a cylindrical club head which is free to rotate.

It is therefore a general object of the invention to provide a putter which overcome the difficulties of prior putters.

It is a further object of the invention to provide a putter which does not cause the ball to skid or jump off the ground on long putts.

It is a still further object of the invention to provide a golf club which improves the player's score without violating the rules and ethics of the game.

Other objects and advantages will become more apparent from the following detailed description of the preferred embodiments and the accompanying drawing.

BRIEF DESCRIPTION OF THE DRAWINGS

As illustrated in FIGS. 1 and 2, the putter of the present invention comprises a golf club head 10 having a substantially cylindrical striking blade 11 merging into a shank 16. The shank 16 is attached in any suitable manner to a shaft 12. The shaft 12 extends upwardly in the usual manner so that the player has a full view of the ball when he is about to strike it with the club.

The rules of the game provide that the shaft of a putter may be fixed at any point in the head and need not remain in line with the heel. Also, the axis of the shaft from the top to a point not more than five inches (127 mm) above the sole shall diverge in the toe-heel plane from the vertical by at least ten degrees in relation to the horizontal line determining the length of the head. In the case of the present invention the preferred angle is about 15 degrees and its shaft is about one inch from the heel 13.

The length of the clubhead is such that the length is greater than the breath. Preferably, the diameter across the face or front 15 is about ¾ to 1½ inches, most preferably about one inch. The length of the blade 11 is about 3 to 5 inches, most preferably about 4 inches.

The clubhead is preferably of a metal having a high degree of toughness such as carbon steel and its alloys. The chrome vanadium steels are particularly adapted to meet the requirements for a clubhead.

Figure 1:
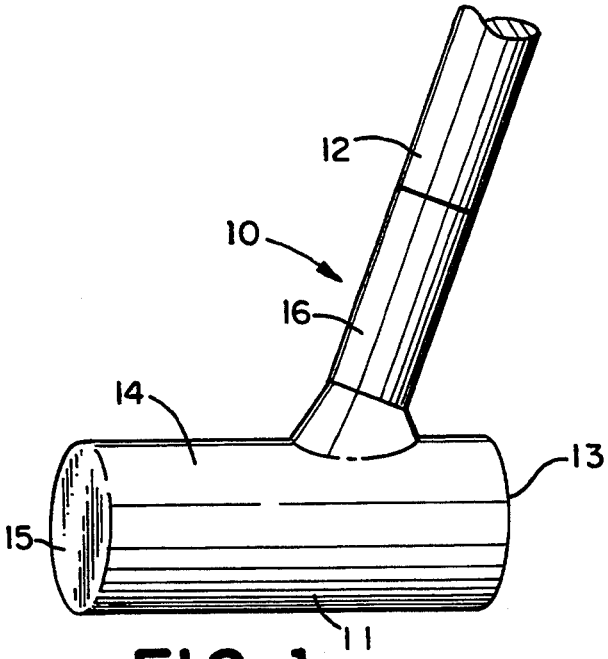
FIG. 1 is a side elevational view illustrating a preferred embodiment of the present invention.
Figure 2:
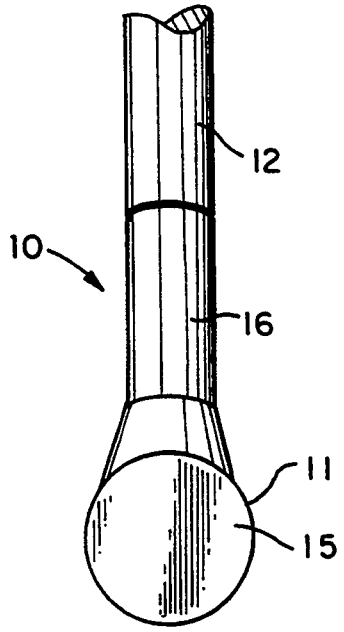
FIG. 2 is a front view of the golf club head of FIG. 1.
Figure 3:
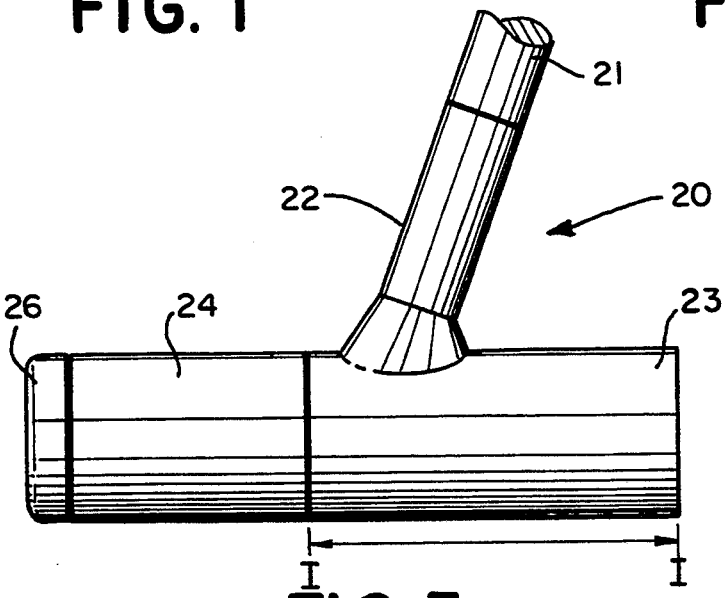
FIG. 3 is a side elevational view of another embodiment of the invention, and FIG. 4. is an exploded view of the golf club of FIG. 3.
Figure 4:
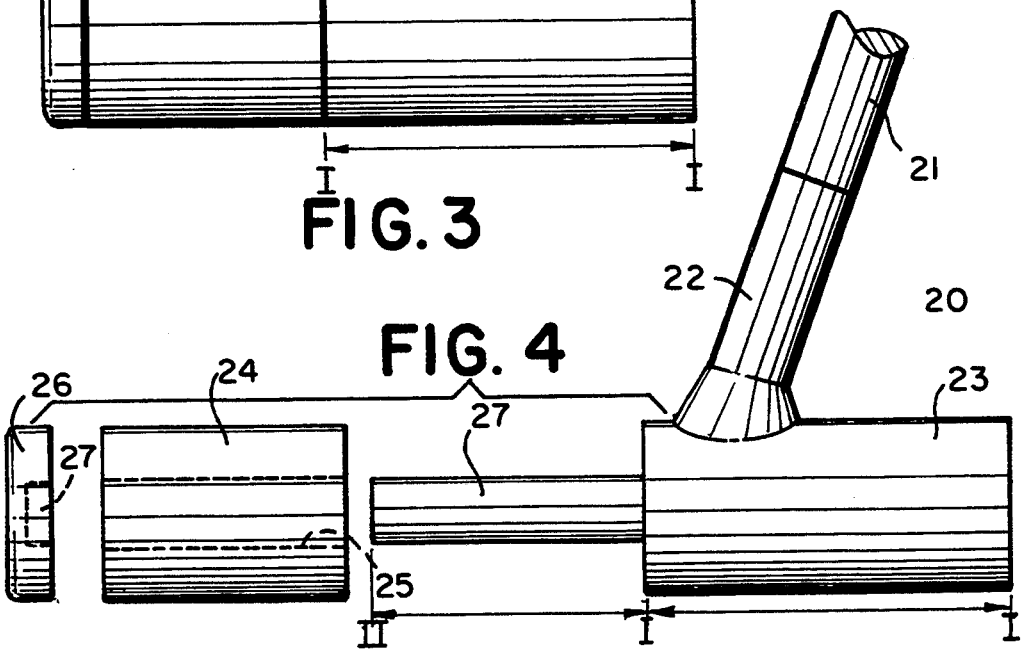

In accordance with another embodiment of the invention as seen in FIGS. 3 and 4 there is provided a clubhead 20 having a striking blade 24 which is rotatable. Similar to the clubhead 10 of FIG. 1, the instant clubhead 20 has a striking portion that merges into a shank 22 which is attached to a shaft 21. The clubhead 20 has a fixed heel portion 23 from which the shank 22 emerges. The heel portion 23 has a stem or forward portion 27 of reduced diameter, preferably about ½ inche in diameter. The length of the reduced diameter portion 27 along line I-II is preferably about 2 to 2½ inches. The length of the heel portion 23 along line I-II is about 1½ inches. A generally cylindrical sleeve or roller blade 24 having a hollow portion 25 is placed for rotation over the stem 27 and is maintained in place with an end cap 26. It is critical that the blade 24 rotate between the abutment 28 of the heel portion 23 and the end cap 26 to achieve the additional advantages of the invention.

The end cap 26 and the abutment 28 may be provided with lubricated surfaces such as teflon to improve rotation of the striking blade. Alternatively, ball bearing races (not shown) may be used.

As various changes may be made in the form, arrangement and construction of parts of the preferred embodiments without departing from the spirit of the invention, it will be understood that all matters herein is to be taken as illustrative and not in a limiting sense.

What is claimed is:

1. A golf clubhead comprising a striking head, a heel portion and a shank portion, said heel portion having a stem of reduced diameter extending therefrom and a cylindrical barrel rotatably carried by said stem forming a freely rotatable striking head.

2. The golf clubhead of claim 1 wherein said striking head is about ¾ to 1½ inches in diameter.

3. The golf clubhead of claim 2 wherein said striking head is about 1 inch in diameter.

4. The golf clubhead of claim 1 wherein said striking head has a striking face about 3 to 5 inches in length.

5. The golf clubhead of claim 4 wherein said striking face is about 4 inches in length.

* * * * *